US006056048A

United States Patent [19]

Takahashi et al.

[11] Patent Number: 6,056,048

[45] Date of Patent: May 2, 2000

[54] FALLING FILM TYPE HEAT EXCHANGER TUBE

[75] Inventors: Hiroyuki Takahashi; Chikara Saeki, both of Kanagawa, Japan

[73] Assignees: Kabushiki Kaisha Kobe Seiko Sho, Kobe; Sanyo Electric Co., Ltd., Moriguchi, both of Japan

[21] Appl. No.: 09/266,914

[22] Filed: Mar. 12, 1999

[30] Foreign Application Priority Data

Mar. 13, 1998 [JP] Japan ..... 10-063771
Apr. 8, 1998 [JP] Japan ..... 10-114167

[51] Int. Cl.[7] ..... F28F 1/36

[52] U.S. Cl. ..... 165/184; 165/133; 165/179

[58] Field of Search ..... 165/179, 184, 165/133

[56] References Cited

U.S. PATENT DOCUMENTS 4,313,248 2/1982 Fujikake ..... 165/179 X
4,549,606 10/1985 Sato et al. ..... 165/184 X
4,715,436 12/1987 Takahashi et al. ..... 165/184 X
5,259,448 11/1993 Masukawa et al. ..... 165/179 X
5,597,039 1/1997 Rieger ..... 165/184 X
5,697,430 12/1997 Thors et al. ..... 165/179 X
5,775,411 7/1998 Schuez et al. ..... 165/184 X

FOREIGN PATENT DOCUMENTS 402037292 2/1990 Japan ..... 165/184
7-71889 3/1995 Japan .

*Primary Examiner*—Christopher Atkinson
*Attorney, Agent, or Firm*—Oblon, Spivak, McClelland, Maier & Neustadt, P.C.

[57] ABSTRACT

A heat exchanger tube includes ribs formed in protrusion on an internal surface of the tube and extending spirally with a suitable distance between adjacent ribs, concavities formed on the external surface of the tube and extending spirally with a suitable distance between adjacent concavities, and a plurality of independent projections formed on the external surface of the tube and laid out spirally. The projections are formed with a recess on their top surfaces in such a way that a portion aligned with the ribs on the internal surface of the tube is lower than a portion aligned with an area between the ribs. Further, the concavities on the external surface of the tube and the ribs on the internal surface of the tube are formed at mutually aligned positions.

15 Claims, 12 Drawing Sheets

$AF = AF_1 / AF_2$

FALLING FILM TYPE HEAT EXCHANGER TUBE

BACKGROUND OF THE INVENTION

1. Field of the Invention

The present invention relates to a falling film type heat exchanger tube, such as a heat exchanger tube for a falling film evaporator for performing a heat exchange between a falling film of refrigerant (water) formed on an external surface of a tube and a water flowing inside this tube to evaporate this refrigerant, and a heat exchanger tube for a falling film absorber for performing a heat exchange between an absorption liquid film dripped or dispersed on an external surface of a tube and a fluid flowing inside this tube to cool the absorption liquid.

2. Description of the Prior Art

Conventionally, an absorption type heat exchanger such as an absorption type chiller has been used in such a way that the inside of the heat exchanger is kept in a vacuum state and a refrigerant on the outer surface of the tube is evaporated at a low temperature to obtain cold water in the tube by extracting an evaporation latent heat from the water in the tube. This cold water obtained is used for an air-conditioner or the like.

According to this heat exchanger, an absorber and an evaporator are accommodated together inside one body. In order to obtain evaporation continuously, a refrigerant vapor generated by the evaporator is absorbed into an absorption liquid dispersed on the surface of a heat exchanger tube, and the inside of the body is maintained at a constant degree of vacuum. Accordingly, in order to improve the refrigeration capacity of an absorption type chiller, it is necessary to increase the quantity of the refrigerant vapor generated in the evaporator and to increase the absorption quantity or the absorption capacity. Improving the performance of the heat exchanger tube is the most effective means for increasing the absorption capacity. For this purpose, the applicant of the present invention proposed a heat exchanger tube having formed independent fins by providing grooves and hills extending in a tube axial direction on an external surface of the tube (Japanese Patent Application Laid-Open Public No. 9-113066).

Further, according to a falling film type evaporator such as an absorption type water cooler, there has been performed a heat exchange between a refrigerant that flows down on an external peripheral surface of a heat exchanger tube and a liquid such as water that flows through inside this tube, thereby to cool the water within the tube. The refrigerant which flows down on the heat exchanger tube spreads out the surface of the heat exchanger tube, and is then evaporated at a low pressure while taking heat, at the same time, from a surface of the heat exchanger tube, thereby to cool the water inside the heat exchanger tube.

As described above, according to the falling film type heat exchanger tube for an evaporator, a refrigerant such as pure water, is dispersed on the external surface of the tube and cold water is passed through inside the tube. Then, a liquid film of the refrigerant is formed on the external surface of the tube. When this refrigerant evaporates, the cold water flowing inside the tube is cooled. In this case, at the time when the refrigerant wet and spread on the surface of the heat exchanger tube evaporates, the latent heat of vaporization is deprived from the heat transfer surface. Therefore, in order to efficiently cool the water inside the tube, it is necessary to increase as far as possible the contact area between the heat exchanger tube and the refrigerant, that is, the area of the heat transfer surface (external surface of the tube).

For providing a falling film type heat exchanger tube that meets this requirement, the applicant of the present invention proposed a heat exchanger tube provided with a large number of fins on the external surface of the tube (Japanese Patent Application Laid-open Public No. 7-71889). According to this conventional heat exchanger tube, there are provided fins extending in a direction to be orthogonal with or in a spiral fashion with respect to a tube axial direction, on the external surface of the tube, and there are also provided grooves on the tops of the fins along with these fins. Further, there are provided concavities crossing an upper half portion of each fin in predetermined pitches. An angle formed between both side walls of each groove is within a range from 70 to 150°.

This heat exchanger tube has an advantage that the spreading property of the refrigerant is excellent, with a large surface area of heat transfer, resulting in a superior heat transfer performance to that of the prior art.

The above-explained conventional heat exchanger tube for an absorber described in Japanese Patent Application Laid-Open Public No. 9-113066 has concavities on the external surface of the tube at the rate of 3 to 25 (concavities/tube circumferential length). Therefore, this tube has sufficient spreading property of the absorption liquid in a tube circumferential direction. However, on the other hand, in the tube axial direction, the spreading property is so poor that the absorption liquid leaves the surface of the tube before the absorption liquid absorbs the vapor generated by the evaporator, with a result of performance reduction.

The above-mentioned conventional heat exchanger tube for an evaporator described in Japanese Patent Application Laid-open Public No. 7-71889 has achieved the initially intended object. However, the heat transfer performance of this tube has come insufficient as a heat exchanger tube for an evaporator for which higher performance has been required increasingly in recent years, as explained below. According to this conventional heat exchanger tube, grooves are provided in a longitudinal direction of fins, and the upper half portion of each fin is divided into two in a Y shape as viewed from the cross section orthogonal with the longitudinal direction of the fins, with the division angle of each fin being within a range from 70 to 150°. Since, these divided portions close the grooves formed between the fins in the end, a spreading property of the refrigerant to the grooves between the fins is poor and thick liquid film is formed, thus lowering the evaporation performance.

Further, the fins are disconnected at concavities extending in a direction orthogonal with the longitudinal direction of the fins. Since, the concavities have a smaller deepness than the height of the fins, thus providing insufficient spreading property of the refrigerant in the tube axial direction. As a result, a liquid film is formed in a large thickness; which lowers the evaporation performance.

SUMMARY OF THE INVENTION

It is an object of the present invention to provide a falling film type heat exchanger tube, including a heat exchanger tube for a falling film absorber with improved spreading property of the absorption liquid in the tube axial direction and a heat exchanger tube for a falling film type evaporator with high evaporation performance of the thinner refrigerant and excellent evaporation heat exchange performance.

A falling film type heat exchanger tube according to the present invention comprises ribs formed in protrusion on an internal surface of the tube and extending spirally with a suitable distance between adjacent ribs, concavities formed on an external surface of the tube and extending spirally with a suitable distance between adjacent concavities, and a plurality of independent projections formed on the external surface of the tube and laid out spirally. Said projection has a recess formed on its upper surface in such a way that an area aligned with the ribs on the internal surface of the tube is lower than an area aligned with an area between the ribs.

In this falling film type heat exchanger tube, it is preferable that the concavities on the external surface of the tube and the ribs on the internal surface of the tube are formed at positions mutually aligned with each other. Each projection is formed in a quadrangular pyramid having a height of, for example, 0.20 to 0.40 mm. Further, it is preferable that each projection has an area rate (A) within a range of $0.25 \leqq A \leqq 0.40$ as the rate of the area of the upper surface to the area of the bottom surface. Further, from the viewpoint of the cross section orthogonal with the tube axis, it is desirable that a pitch (P) of the concavities on the upper surface of the independent projections is within a range of $5.75 \leqq P \leqq 6.75$ mm. Further, it is desirable that an angle θ formed by the rib and the tube axial direction is within a range of $40° \leqq \theta \leqq 44°$. Further, it is preferable that a pitch PF of the projections in the tube axial direction is within a range of $0.89 \leqq PF \leqq 1.12$ mm.

According to the present invention, the independent projections having a quadrangular pyramid shape, for example, are disposed spirally on the external surface of the tube, and the upper surface of the projection has a recess corresponding to an area of the rib on the internal surface of the tube. The upper surface of the projection has a high portion and a low portion. With this arrangement, when a refrigerant is dispersed, the refrigerant at the high portion is pulled into the low portion by the surface tension, with a resultant reduction in the film thickness of the refrigerant at the high portion of the projection, which improves the evaporation heat transfer performance. Further, when the dispersed refrigerant flows along an area between the projections disposed spirally, the refrigerant is induced to the concavities formed on the external surface of the tube, thus reducing the thickness of the refrigerant existing at other portions, which improves the evaporation heat transfer performance.

According to the present invention, the projections provided mutually independent of each other on the external surface of the tube are formed to have their edge extending in the tube axial direction. Accordingly, the distance between the projections in the tube axial direction changes in a tube circumferential direction, so that the size of space sandwiched between the projections changes. As a result, a liquid dripped or dispersed on the external surface of the heat exchanger tube does not flow smoothly in the tube circumferential direction and flows smoothly in the tube axial direction. Thus, the spreading property of the liquid in the tube axial direction improves.

The heat exchanger tubes are usually made of copper or copper alloy, but they can also be made of aluminum, aluminum alloy, steel, titanium or the like.

DETAILED DESCRIPTION OF THE PREFERRED EMBODIMENTS

Figure 1:
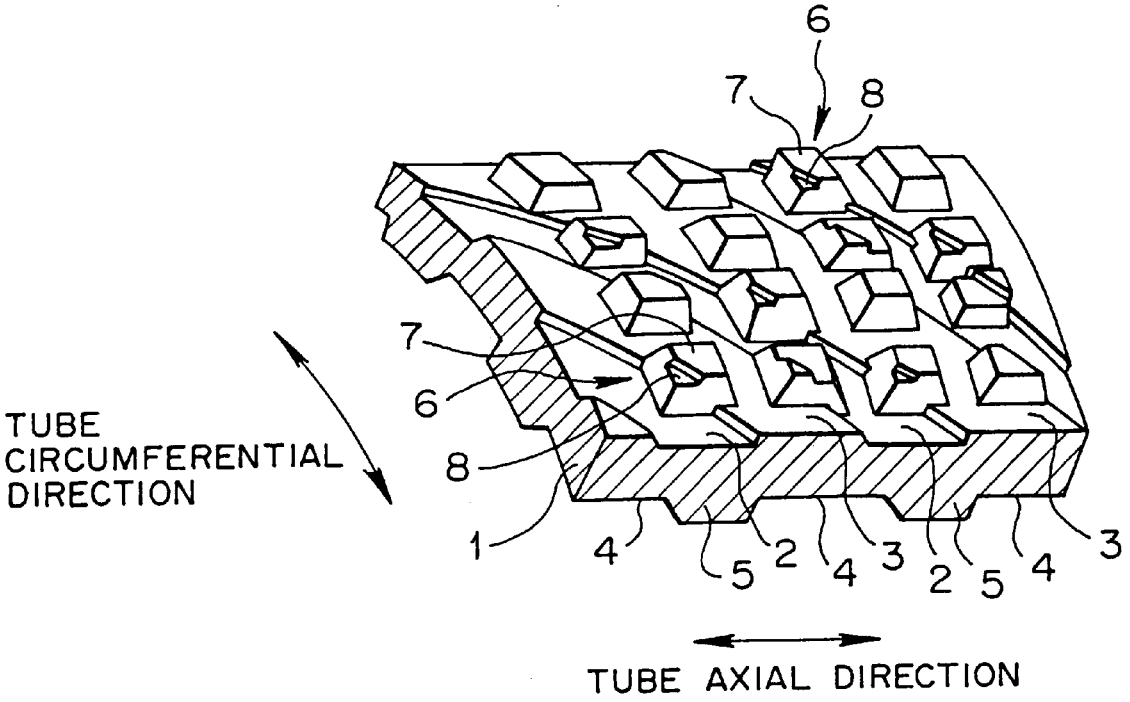
FIG. 1 is a perspective view for showing a part of a falling film type heat exchanger tube relating to an embodiment of the present invention.

There will be described in detail below preferred embodiments of the present invention with reference to the attached drawings. FIG. 1 is a partially cut open perspective view of a falling film type heat exchanger tube according to a first embodiment of the present invention. FIG. 1 shows a part of an area of the tube in a tube axial direction and in a tube circumferential direction. As shown in this drawing, a heat exchanger tube 1 of the present embodiment have protrusions or ribs 5 formed on an internal surface of the tube, to extend in a direction slanting to a tube axial direction, that is, in a spiral direction, with a suitable distance left between the adjacent ribs. On an external surface of the tube, there are formed concavities 2 extending spirally in a similar manner. The concavities 2 on the external surface of the tube and the ribs 5 on the internal surface of the tube are disposed in mutually aligned positions. Concavities 4 are formed in areas sandwiched between the ribs 5 on the internal surface of the tube, and convexities 3 are formed in areas sandwiched between the concavities 2 on the external surface of the tube.

On the external surface of the tube, there are disposed independent projections 6 dotted spirally. A slope angle of the spirally disposed projections 6 with respect to a tube axial direction is different from a slope angle of the spirally disposed concavities 2 with respect to the tube axial direction, and the layout direction of the projections 6 and the extension direction of the concavities 2 mutually cross each other. Of those projections 6, the projections 6 disposed to partly extend to the concavities 2 have a recess on their top surface at positions aligned with those concavities 2. Accordingly, each of these projections 6 have a portion 7 above the convexity 3 and a portion 8 above the concavity 2, with the portion 7 higher than the portion 8, so that there is generated a stage between the portion 7 and the portion 8.

Figure 2:
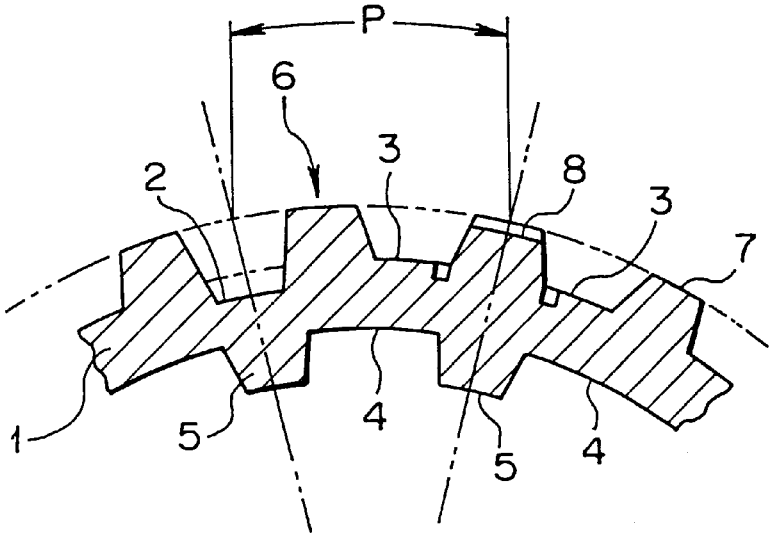
FIG. 2 is a cross sectional view for explaining a pitch (P) of concavities.

FIG. 2 is a cross sectional view of the heat exchanger tube 1 shown in FIG. 1, cut along a line orthogonal with the tube axial direction. In the tube circumferential direction, the concavity appears as the concavity 2 itself or as a recess (portion 8) on the upper surface of the projection 6. Accordingly, a pitch P of the concavities 2 in the tube circumferential direction is indicated by an arrow shown in FIG. 2. The pitch P lies in an envelope on the upper surface of the projections 6.

Figure 3:
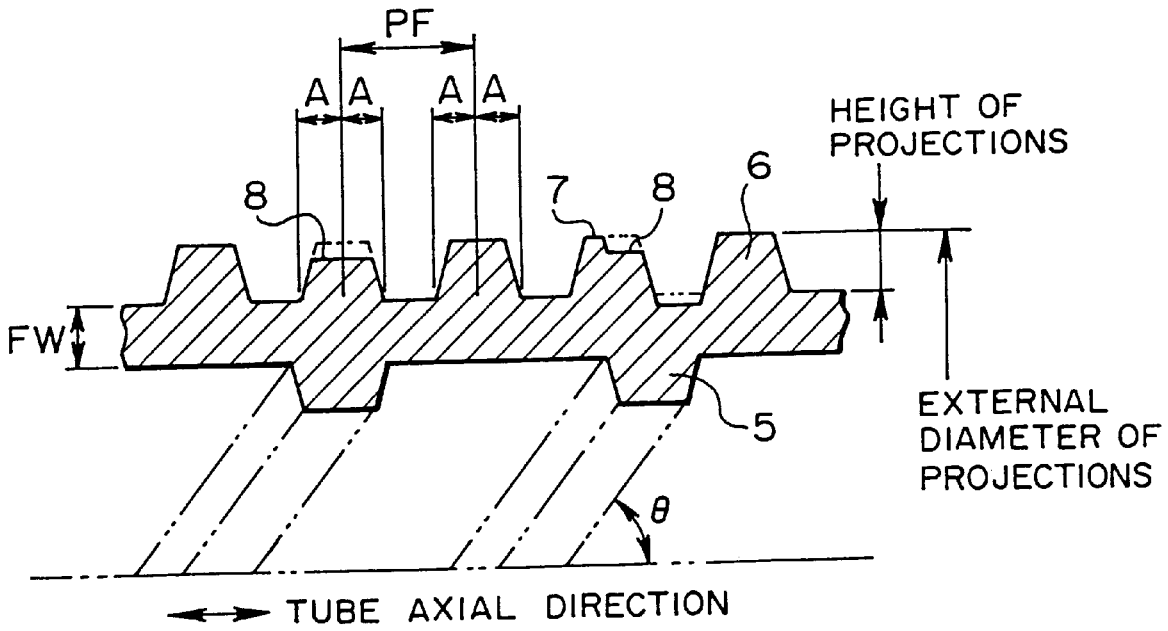
FIG. 3 is a cross sectional view for explaining a lead angle of ribs.

FIG. 3 is a cross sectional view of the heat exchanger tube 1 shown in FIG. 1 cut along a tube axial direction. As shown in FIG. 3, an angle formed by the extension direction of the spirally extended ribs 5 with respect to the tube axial direction is θ. This θ is an angle formed by the crossing of the line extending in parallel with the tube axis with the ribs 5 on the internal surface of the tube. A pitch (PF) of the projections in the tube axial direction is a pitch expressed at a center position of the top of the projections.

Next, there will be explained below an operation of the falling film type heat exchanger tube for an evaporator of the above-described structure according to the present embodiment. At first, water is flown through inside the heat exchanger tube 1, and a refrigerant (water) is flown down or dispersed on the external surface of the tube. Then, the refrigerant adheres to the external surface of the tube to form a liquid film. The refrigerant in the form of the liquid film is evaporated at a low pressure, and the water flowing through inside the heat exchanger tube is cooled by the evaporation latent heat when the refrigerant evaporates.

In this case, some of the independent projections 6 laid out spirally on the external surface of the tube each have a stage formed by the high portion 7 and the low portion 8 on the top surface of the projection. Accordingly, soon after the refrigerant is dispersed, the refrigerant located at the high portion 7 is pulled into the refrigerant at the low portion 8 by the surface tension, so that the refrigerant at the high portion 7 has a thinner film. Further, at the bottom of the projections 6, the refrigerant flows through the space between the projections. However, since the portions of the external surface of the tube corresponding to the ribs 5 on the internal surface are the concavities 2 having a recess, the refrigerant is guided to the concavities 2 and flows along these concavities 2. As a result, the refrigerant at other portions is a thinner film. Since the refrigerant on the external surface of the tube is a thinner film, the heat transfer performance is improved, which facilitates an evaporation of the refrigerant.

It is preferable that the projections 6 are formed in a quadrangular pyramid having a height within a range from 0.20 to 0.40 mm. If the height of the projections 6 becomes lower than 0.2 mm, the gap between the high portion of the projections and the bottom between the projections becomes smaller. This reduces the quantity of the refrigerant pulled into the refrigerant at the concavities by the surface tension, making the refrigerant at the high portions 7 of the projections 6 to have a thicker film, which results in a reduction of the cooling performance. On the other hand, if the projections 6 are higher than 0.4 mm, the refrigerant at the high portions of the projections is pulled into the space between the projections by the surface tension, and the refrigerant at the high portions of the projections is a thinner film. However, since the refrigerant is pulled into the space between the projections so easily, the refrigerant in this space is a heavier film, which lowers the cooling performance. Therefore, it is preferable to have the height of the projections 6 within the range from 0.20 to 0.40 mm.

It is preferable that the rate (A), which is the rate of an upper surface area (S1) of the projection 6 to a bottom area (S2) of the projection determined by the outline of the lower end of the projection, that is, (A)=S1/S2, is within a range from 0.25 to 0.4. These areas S1 and S2 are the projected areas of the surfaces. Therefore, each of S1 and S2 does not change regardless of the existence of convex and concave surfaces. If the area rate (A) is less than 0.25, the areas of the fin front ends are reduced and the refrigerant at the projection front ends easily flows to the space between the projections. Thus, the refrigerant between the projections is a thicker film, which lowers the cooling performance. On the other hand, if the area rate (A) exceeds 0.40, the distance between the projections 6 becomes smaller, and the spreading property of the refrigerant does not occur. Therefore, the area rate (A) is set at a value within the range from 0.25 to 0.40.

It is preferable that the pitch (P) on the upper surface of the projections in the tube circumferential direction of the concavities 2 is within a range from 5.75 to 6.75 mm. If the pitch (P) of the concavities 2 is less than 5.75 mm, the refrigerant is not pulled by the surface tension, and the refrigerant is thick, which has no cooling effect. On the other hand, if the pitch (P) exceeds 6.75 mm, the concavities are reduced although there exists the surface tension, which lowers the cooling effect. Therefore, it is preferable that the pitch (P) of the concavities is within the range from 5.75 to 6.75 mm.

It is preferable that the angle θ formed by the concavities 2 in the tube axial direction is within a range from 40° to 44°. If the angle θ is less than 40°, the refrigerant is not pulled by the surface tension, and the refrigerant film is thicker, which shows no cooling effect. On the other hand, if the angleθ exceeds 44°, the concavities are reduced although there exists the surface tension, which lowers the cooling effect. Therefore, it is preferable that the angle θ formed by the concavities 2 in the tube axial direction is within the range from 40° to 44°.

Further, it is preferable that the pitch PF of the projections 6 on the external surface of the tube in the tube axial direction is within a range of $0.89 \leqq PF \leqq 1.12$ mm. If the pitch PF is less than 0.89 mm, the refrigerant does not flow easily to the space between the projections and the spreading property of the refrigerant on the tube surface becomes poor, which lowers the cooling performance. On the other hand, if the pitch PF exceeds 1.12 mm, the refrigerant flows to the space between the projections so easily that the refrigerant between the projections is thicker, which lowers the cooling performance.

The heat exchanger tube of the shape shown in FIG. 1 can be manufactured in the following manner. For example, a phosphorus deoxidized copper tube (JISH3300, C1201-1/

2H) having an external diameter of 16 mm and a thickness of 0.7 mm, is used, and spiral fins are formed, by rolling, on the external surface of the tube in constant pitches in a tube axial direction, and the spiral fins are pressed in constant pitches in the circumferential direction with a gear disk, thereby to form the spirally located independent projections on the external surface of the tube, as shown in FIG. 1. Further, on the internal surface of the tube, a mandrel formed with grooves in a spiral shape is disposed, to form spiral ribs on the internal surface of the tube at the same time when the spiral fins are formed on the external surface of the tube. Thus, the heat exchanger tube shown in FIG. 1 can be manufactured.

The original tube to be used is not limited to a phosphorus deoxidized copper tube, but various other materials such as copper alloy, aluminum alloy, steel, titanium etc. can also be used for this tube. Further, the heat-treating of the tube material is not limited to 1/2H hardened, but this may also be soft annealed temper.

Next, a second embodiment of the present invention will be explained. The following embodiments are suitable for the heat exchanger tube for an absorber.

Figure 4:
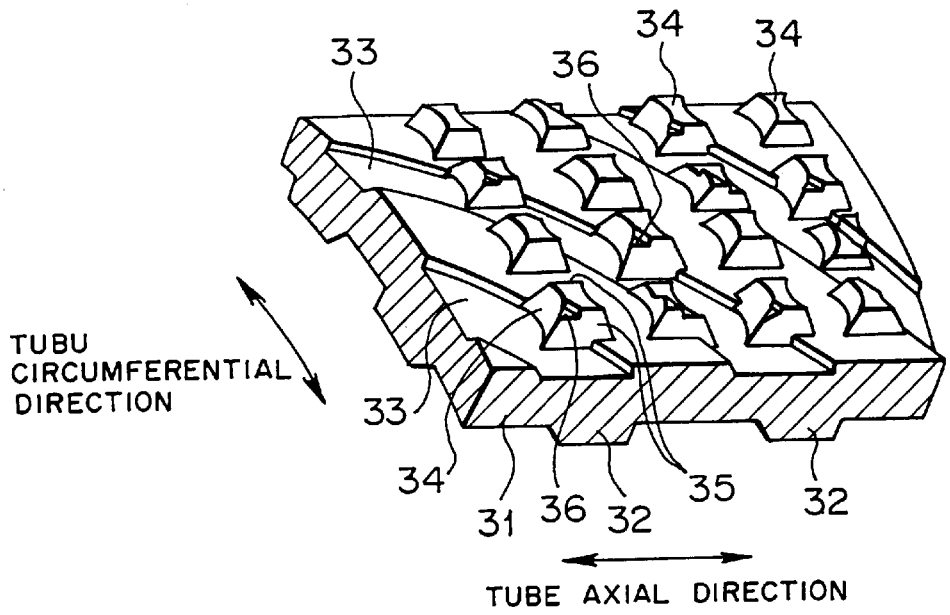
FIG. 4 is a perspective view for showing a part of an absorption type heat exchanger tube relating to an another embodiment of the present invention.
Figure 5:
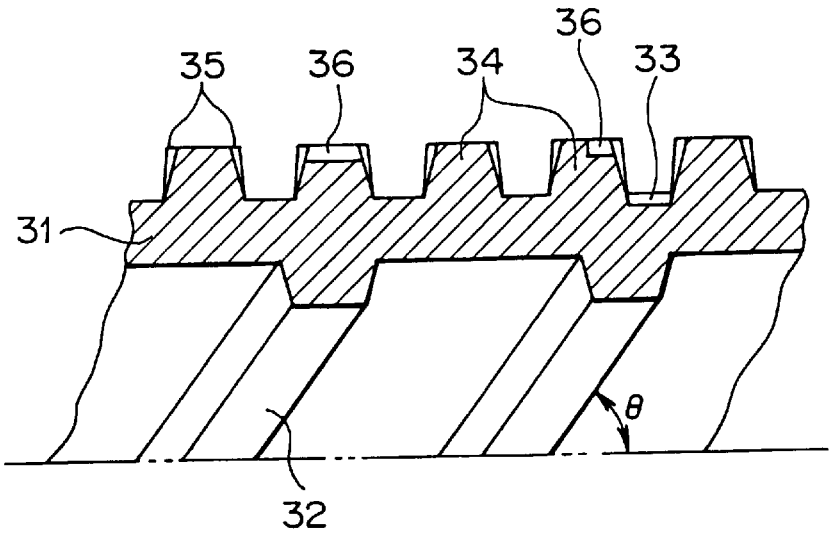
FIG. 5 is a cross sectional view of the absorption type heat exchanger tube shown in FIG. 4, including a tube axis.
Figure 8:
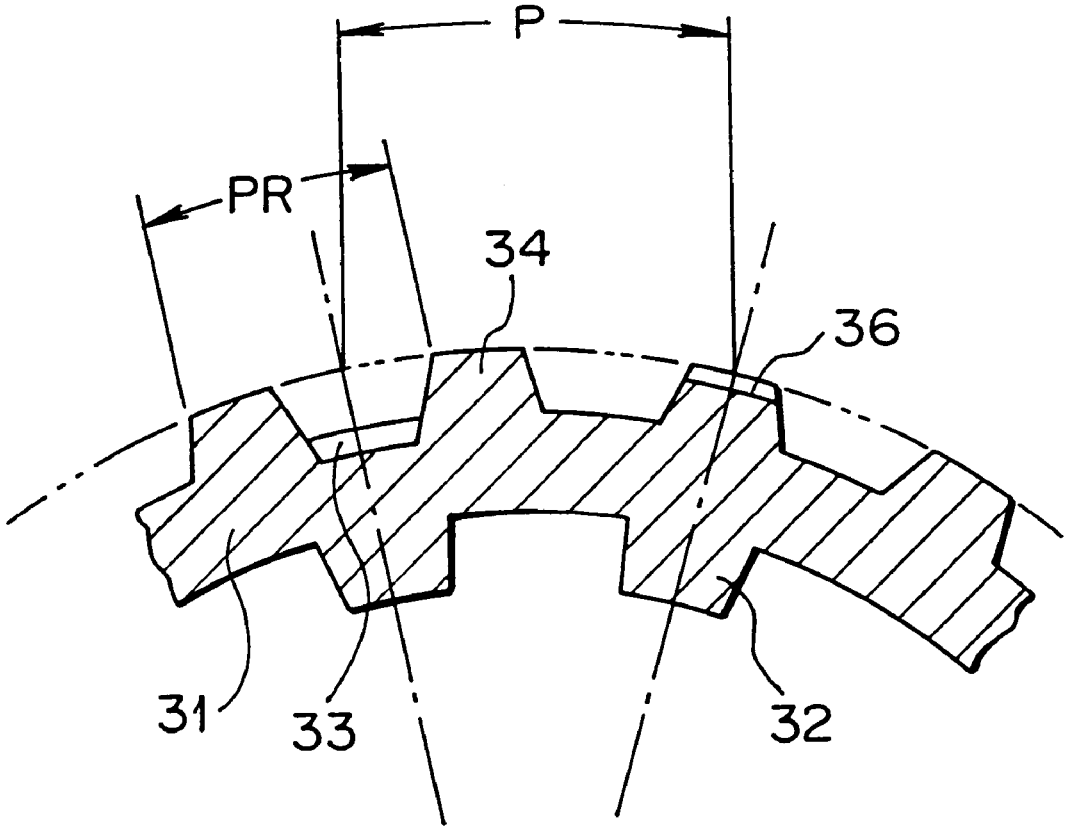
FIG. 8 is a cross sectional view of a surface orthogonal with a tube axis.

FIG. 4 is a perspective view for showing a part of a heat exchanger tube for an absorber relating to a second embodiment of the present invention. FIG. 5 is a cross sectional view cut by a plane including a tube axis. FIG. 8 is a cross sectional view cut by a plane orthogonal with the tube axis. A heat exchanger tube 31 has a plurality of ribs 32 formed on its internal surface, to extend spirally in a direction deviated from the tube axial direction. On the external surface of the heat exchanger tube 31, there are formed concavities 33 extending spirally in a similar manner, in areas aligned with the ribs 32. There are also provided mutually independent projections 34 on the external surface of the heat exchanger tube 31. These projections 34 have basically a quadrangular pyramid shape, and these projections 34 have extended part 35 formed, extending in the tube axial direction, on both sides of each projection parallel to the tube axial direction. The upper surface of each projection 34 is formed with a recess 36 to be concave in areas aligned with the concavities 33 on the external surface of the tube (and also aligned with the ribs 32 on the internal surface of the tube).

In the heat exchanger tube for an absorber having the above-described structure, the projections 34 are provided mutually independently on the external surface of the tube, and their edge portions are formed to extend to the tube axial direction to provide the extended part 35. Accordingly, the space sandwiched between the projections in the tube axial direction becomes uneven with respect to the circumferential direction of the tube. This structure facilitates the flow of an absorption liquid (LiBr), dripped or dispersed on the external surface of the heat exchanger tube, to the tube axial direction, which improves the spreading property of the absorption liquid. Conventional heat exchanger tube of this type has a thickness of about 1.2 mm or more for the tube of 15.88 mm diameter. However, according to the present embodiment, wall thickness of the tube is set at 0.75 mm or less by an improved tube processing method. By this arrangement, there are formed the concavities 33 in the areas of the external surface of the tube aligned with the portions of the spiral ribs 32 on the internal surface of the tube, that is, the protruded parts on the internal surface of the tube. By the generation of these concavities 33, the flow speed of the absorption liquid on the external surface of the tube to the tube circumferential direction becomes slower as compared with the case where there are no concavities 33, which promotes the spreading property of the absorption liquid in the tube axial direction.

In this case, if each of the independent projections 34 that basically forms a quadrangular pyramid has the area rate A to be less than 0.25 as the rate of the area of the upper surface to the area of the bottom of this projection, the area of the upper surface of each fin is reduced. Therefore, it becomes easy for the liquid, dripped or dispersed on the heat exchanger tube, to flow into the space sandwiched between the projections, and Marangoni convection is interrupted. Further, when the area rate (A) exceeds 0.40, the space between the projections is narrowed, so that the absorption liquid does not flow smoothly to this space, which lowers the heat transfer performance. Therefore, it is preferable that the area rate (A) of the area of the upper surface to the area of the bottom of the projections is within a range from 0.25 to 0.40.

Further, as shown in FIG. 8, in the cross section orthogonal with the tube axis, if the pitch P of the concavities 36 as the circumferential length on the top surface of the projections 34 is less than 5.75 mm, the flow speed of the liquid in the tube circumferential direction is decreased, but the absorption liquid becomes thicker on the external surface of the tube, which lowers the heat transfer performance. On the other hand, if the pitch P exceeds 6.75 mm, the flow speed of the liquid in the tube circumferential direction is increased, and the spreading property of the absorption liquid in the tube axial direction becomes poor. Therefore, it is preferable that the pitch P of the concavities 36 is within a range from 5.75 to 6.75 mm.

If the angle θ formed by the concavities 33 on the external surface of the tube with respect to the tube axis direction is less than 30°, the flow speed of the absorption liquid in the tube circumferential direction is decreased, which lowers the heat transfer performance. On the other hand, if the angle θ exceeds 50°, the flow speed of the solution in the tube circumferential direction is increased, which lowers the spreading property in the tube axial direction. Therefore, it is preferable that the angle θ is set at a value within a range from 30 to 50°.

As shown in FIG. 5, if the pitch PF of the projections 34 in the tube axial direction is less than 0.62 mm, the space between the projections 34 is narrowed, and the absorption liquid does not flow smoothly to this space, thus lowing the heat transfer performance. On the other hand, if the pitch PF exceeds 1.33 mm, the space between the projections 34 becomes too wide to lower the spreading property of the absorption liquid in the tube axial direction, thus lowering the heat transfer performance. Therefore, it is preferable that the pitch PF of the projections 34 in the tube axial direction is within a range from 0.62 to 1.33 mm.

Further, as shown in FIG. 8, if a pitch PR of the projections in the tube circumferential direction is less than 0.50 mm, the spreading property of the absorption liquid in the tube axial direction is lowered, thus lowering the heat transfer performance. On the other hand, if the pitch PR exceeds 1.20 mm, the absorption liquid dripped or dispersed on the heat exchanger tube 31 becomes easy to flow in the tube circumferential direction, thus lowering the spreading property of the absorption liquid.

Figure 6:
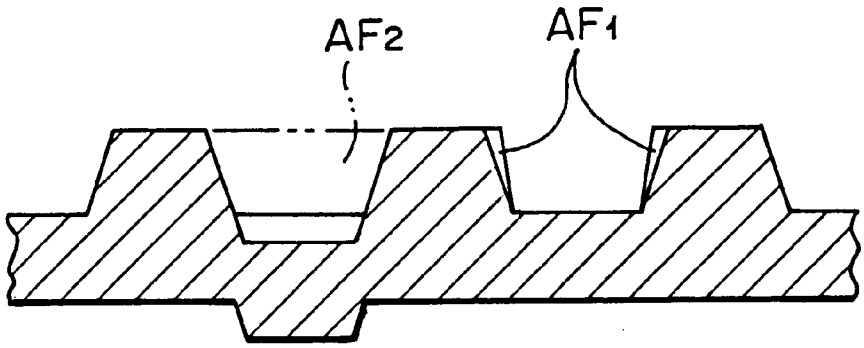
FIG. 6 is a view for explaining an area rate A.
Figure 7:
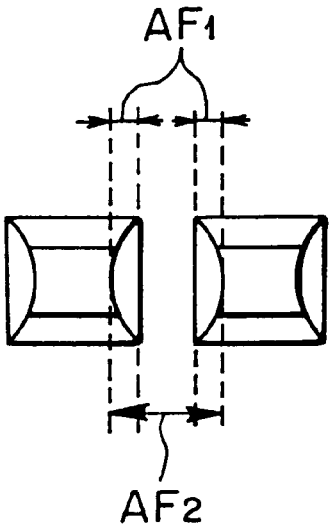
FIG. 7 is a top plan view of projections.

Furthermore, as shown in FIGS. 6 and 7, if an area rate AF, which is a rate of an area AF1 of the extended part 35 of the edge portion of the projections to an area AF2 of the space between the projections 34, that is, AF=AF1/AF2, is less than 0.05, the absorption liquid dripped or dispersed on the heat exchanger tube becomes easy to flow in the tube circumferential direction, thus lowering the spreading property of the absorption liquid. On the other hand, if the area rate AF exceeds 0.65, the solution dripped or dispersed on the heat exchanger tube does not flow smoothly between the projections, thus lowering the spreading property of the absorption liquid. Therefore, it is preferable that the area rate AF is within a range from 0.05 to 0.65.

First Examples

Examples for verifying the effect of the above-described numerical value ranges are shown below in comparison with comparative examples that are out of the scope of claims 4 to 8 of the present invention.

TABLE 1

| | Original Tube | | Fin Fabricated Part | | | | | | | Evaporation Heat Transfer Performance | Evaporation Heat Transfer Performance |
|---|---|---|---|---|---|---|---|---|---|---|---|
| No. | $D_o$ | T | DF | FH | FW | PF | A | P | θ | $K_o$ | $K_o$ |
| Example | | | | | | | | | | | |
| A1 | 16.0 | 0.7 | 15.85 | 0.30 | 0.55 | 0.977 | 0.377 | 6.22 | 43 | 3200 | 2150 |
| A2 | 16.0 | 0.7 | 15.83 | 0.31 | 0.54 | 0.907 | 0.375 | 6.22 | 43 | 3180 | 2200 |
| A3 | 16.0 | 0.7 | 15.84 | 0.30 | 0.56 | 1.104 | 0.382 | 6.22 | 43 | 3110 | 2180 |
| A4 | 16.0 | 0.7 | 15.85 | 0.30 | 0.55 | 0.977 | 0.377 | 6.24 | 40 | 3195 | 2160 |
| A5 | 16.0 | 0.7 | 15.85 | 0.30 | 0.55 | 0.977 | 0.377 | 6.24 | 44 | 3180 | 2160 |
| A6 | 19.0 | 0.7 | 18.90 | 0.30 | 0.55 | 0.977 | 0.377 | 5.94 | 43 | 3205 | 2180 |
| A7 | 16.0 | 0.7 | 15.91 | 0.31 | 0.55 | 0.976 | 0.377 | 5.81 | 43 | 3198 | 2190 |
| A8 | 12.7 | 0.7 | 12.60 | 0.30 | 0.55 | 0.977 | 0.377 | 6.59 | 43 | 3203 | 2170 |
| A9 | 16.0 | 0.7 | 15.84 | 0.30 | 0.55 | 0.977 | 0.391 | 6.22 | 43 | 3185 | 2160 |
| A10 | 16.0 | 0.7 | 15.84 | 0.30 | 0.55 | 0.977 | 0.321 | 6.22 | 43 | 3183 | 2180 |
| A11 | 16.0 | 0.7 | 15.85 | 0.30 | 0.55 | 0.977 | 0.262 | 6.22 | 43 | 3190 | 2190 |
| A12 | 16.0 | 0.7 | 15.85 | 0.21 | 0.65 | 0.977 | 0.377 | 6.22 | 43 | 3185 | 2220 |
| A13 | 16.0 | 0.7 | 15.84 | 0.38 | 0.52 | 0.977 | 0.377 | 6.22 | 43 | 3203 | 2240 |
| Comparative Example | | | | | | | | | | | |
| B1 | 16.0 | 0.7 | 15.85 | 0.31 | 0.55 | 0.847 | 0.375 | 6.22 | 43 | 2682 | 1610 |
| B2 | 16.0 | 0.7 | 15.84 | 0.30 | 0.55 | 0.877 | 0.375 | 6.22 | 43 | 2769 | 1670 |
| B3 | 16.0 | 0.7 | 15.84 | 0.31 | 0.55 | 1.175 | 0.375 | 6.22 | 43 | 2883 | 1620 |
| B4 | 16.0 | 0.7 | 15.84 | 0.30 | 0.56 | 1.337 | 0.375 | 6.22 | 43 | 2850 | 1680 |
| B5 | 16.0 | 0.7 | 15.85 | 0.30 | 0.54 | 0.976 | 0.249 | 6.22 | 43 | 2812 | 1640 |
| B6 | 16.0 | 0.7 | 15.85 | 0.31 | 0.55 | 0.976 | 0.410 | 6.22 | 43 | 2705 | 1680 |
| B7 | 16.0 | 0.7 | 15.85 | 0.30 | 0.56 | 0.976 | 0.377 | 5.53 | 43 | 2870 | 1640 |
| B8 | 16.0 | 0.7 | 15.84 | 0.29 | 0.55 | 0.977 | 0.378 | 5.64 | 43 | 2882 | 1640 |
| B9 | 16.0 | 0.7 | 15.86 | 0.31 | 0.55 | 0.976 | 0.376 | 7.11 | 43 | 2850 | 1630 |
| B10 | 16.0 | 0.7 | 15.84 | 0.30 | 0.56 | 0.976 | 0.377 | 6.92 | 43 | 2868 | 1640 |
| B11 | 16.0 | 0.7 | 15.85 | 0.30 | 0.54 | 0.976 | 0.378 | 6.22 | 38 | 2775 | 1660 |
| B12 | 16.0 | 0.7 | 15.84 | 0.31 | 0.54 | 0.977 | 0.376 | 6.22 | 39 | 2882 | 1630 |
| B13 | 16.0 | 0.7 | 15.84 | 0.30 | 0.55 | 0.975 | 0.377 | 6.22 | 45 | 2880 | 1620 |
| B14 | 16.0 | 0.7 | 15.86 | 0.19 | 0.67 | 0.977 | 0.377 | 6.22 | 43 | 2830 | 1670 |
| B15 | 16.0 | 0.7 | 15.85 | 0.43 | 0.50 | 0.977 | 0.377 | 6.22 | 43 | 2860 | 1630 |

Table 1 above shows sizes of the external surface and the internal surface of a tube. In Table 1, each mark denotes following size.

$D_O$: external diameter of the original tube (mm)

T: wall thickness of the original tube (mm)

DF: maximum external diameter of the fin fabricated part (mm)

FH: height of the projections (mm)

FW: thickness of the bottom wall (mm)

PF: pitch of the projections (mm)

A: area rate of the projections

P: pitch of the concavities (mm)

θ: angle formed by the ribs in the tube axial direction (°)

$K_O$: overall heat transfer coefficient (kcal/m$^2$·h ° C.)

Figure 9:
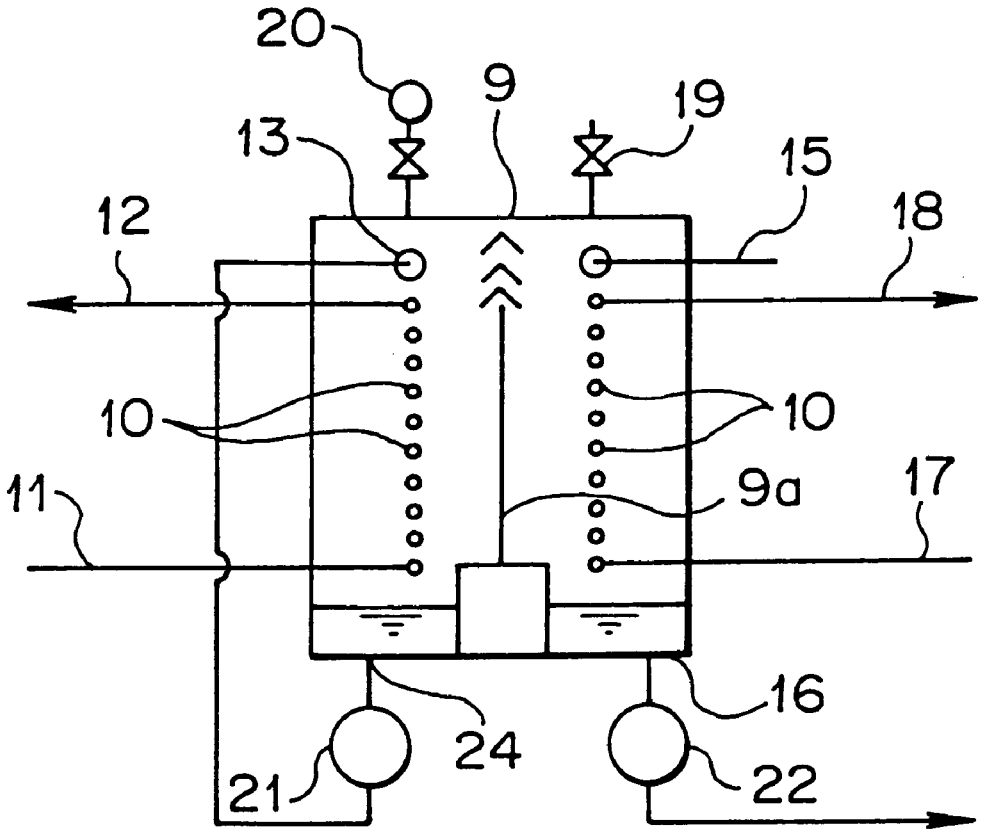
FIG. 9 is a diagram for showing a testing apparatus to be used for testing the performance of heat exchanger tubes.

FIG. 9 shows a testing apparatus used for carrying out an evaluation of the performance of these heat exchanger tubes. The inside of a chamber 9 is divided by a partition 9*a* into two chambers of an evaporator and an absorber respectively. In each of the divided chambers, heat exchanger tubes 10 are disposed horizontally, and they are connected in series respectively. Vapor can flow through the top of the partition 9*a*.

In the evaporator, water is introduced into the heat tube 10 from a water inlet 11, and this water is discharged from a water outlet 12 of the heat exchanger tube 10 at the top end. On the upper side of these heat exchanger tubes 10, there is provided a refrigerant inlet 13 for guiding the refrigerant into the chamber. The refrigerant (water) is falling down onto these heat exchanger tubes 10 from the refrigerant inlet 13. A refrigerant pump 21 pumps up the refrigerant pooled within the chamber to the refrigerant inlet 13 from a refrigerant outlet 24.

On the other hand, in the absorber, cooling water is introduced into the heat exchanger tube 10 at the lower end from a cooling water inlet 17, and this cooling water is discharged from the heat exchanger tube 10 at the top end through a cooling water outlet 18. Above these heat exchanger tubes 10, there is provided a LiBr water solution inlet 15 for introducing LiBr water solution into the chamber, and the LiBr water solution is flown down onto the heat exchanger tubes 10 from this LiBr water solution inlet 15. The LiBr water solution pooled at the bottom of the chamber 9 is discharged from the LiBr water solution outlet 16 by a pump 22. In the chamber 9, there are also provided a digital manometer 20 and a valve 19 for discharging gas from the chamber 9.

In the evaporator, the refrigerant which has cooled the water flowing inside the heat exchanger tube 10 by the evaporation of the refrigerant, is pooled partly in the form of a liquid at the bottom of the chamber, and the rest of the refrigerant enters the absorber through the top of the partition 9*a* as a vapor. The refrigerant vapor is then absorbed into the LiBr water solution flowing down onto the heat exchanger tubes 10.

Testing conditions for testing the performance of the evaporator are as follows.

Evaporation pressure: 6.0 mmHg

Dispersed quantity of the refrigerant: 1.00 kg/m.min.

Flow speed of the cold water: 1.50 m/sec (set based on the cross section of the tube end)

Temperature of the cold water at the outlet: 7.0° C.

Layout of the tubes: 1 rows×4 stages (stage pitch 24 mm)

Number of paths: 4 paths

Testing conditions for testing the performance of the absorber are as follows.

Evaporation pressure: 6.0 mmHg

Density of the LiBr water solution at the inlet: 63% by weight

Temperature of the LiBr water solution at the inlet: 46° C.

Flow speed of the cooling water: 1.50 m/sec

Temperature of the cooling water at the outlet: 32° C.

Layout of the tubes: 1 row×6 stages (stage pitch 24 mm)

Number of paths: 6 paths

Surfactant: 2-ethylhexanol-added

Absorption liquid quantity of the LiBr water solution: 0.027 kg/ms

An overall heat transfer coefficient $K_0$ was calculated from the measured values obtained, based on the following equation (1).

$$K_0:Q/(\Delta T/A_0) \quad (1)$$

Where;

$Q=G\cdot Cp\cdot(Tin-Tout)$ $\Delta Tm=(Tin-Tout)/In\ \{(Tin-Te)/(Tout-Te)\}$ $A_0$: $=\pi\cdot D_0\cdot L\cdot N$ Q: cooling capacity of the evaporator (kcal/h)

G: flow quantity of the water (kg/h) in evaporator

Cp: specific heat of the water (kcal/kg·° C.)

Tin: temperature of the water at the inlet (° C.)

Tout: temperature of the water at the outlet (° C.)

ΔTm: algorithmic average temperature difference of Tin and Tout (° C.)

Te: evaporation temperature of the refrigerant (° C.)

$K_0$: overall heat transfer coefficient (kcal/m$^2$h° C.)

$A_0$: standard external surface area of the original tube (m$^2$)

$D_0$: external diameter of the original tube (m)

L: effective length of the tube (m)

N: number of tubes (piece)

Figure 10:
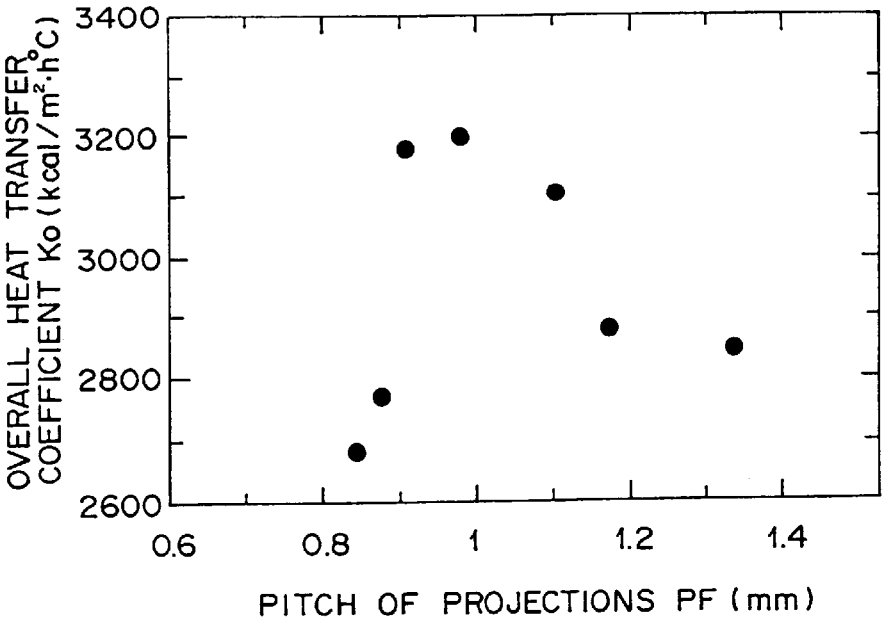
FIG. 10 is a graph for showing a relationship between an overall heat transfer coefficient and a pitch of projections.
Figure 11:
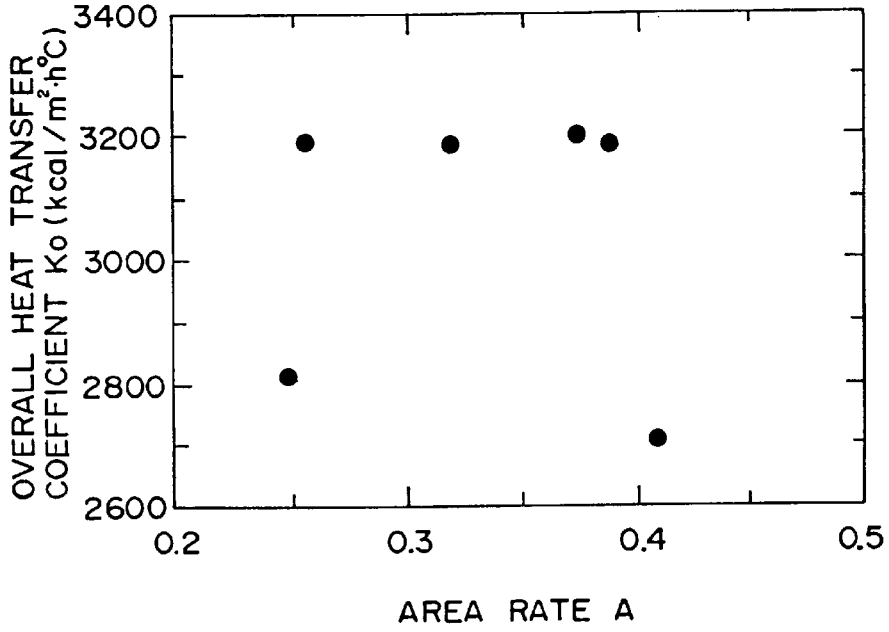
FIG. 11 is a graph for showing a relationship between an overall heat transfer coefficient and the area rate A.
Figure 12:
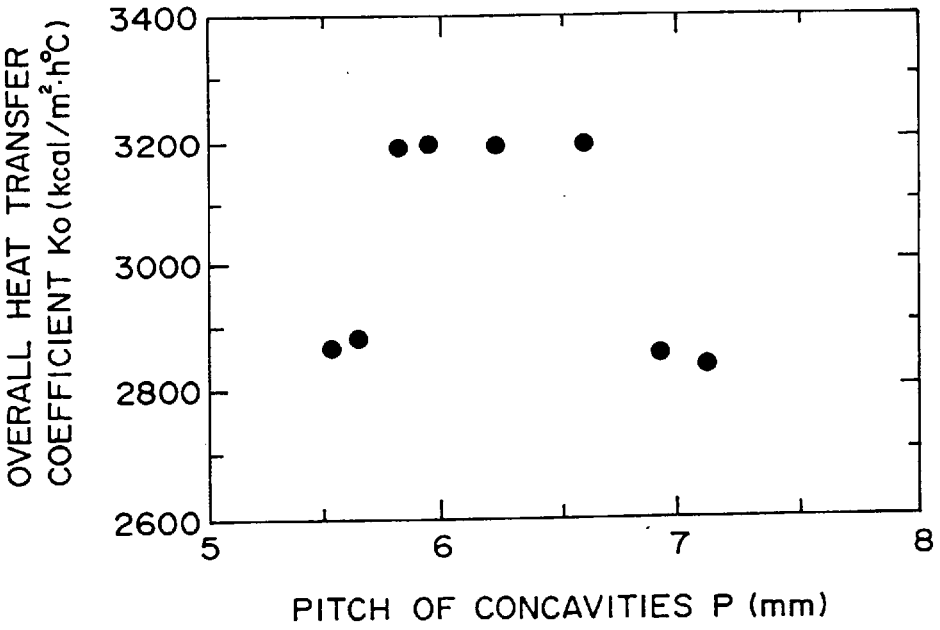
FIG. 12 is a graph for showing a relationship between an overall heat transfer coefficient and a pitch P of concavities.
Figure 13:
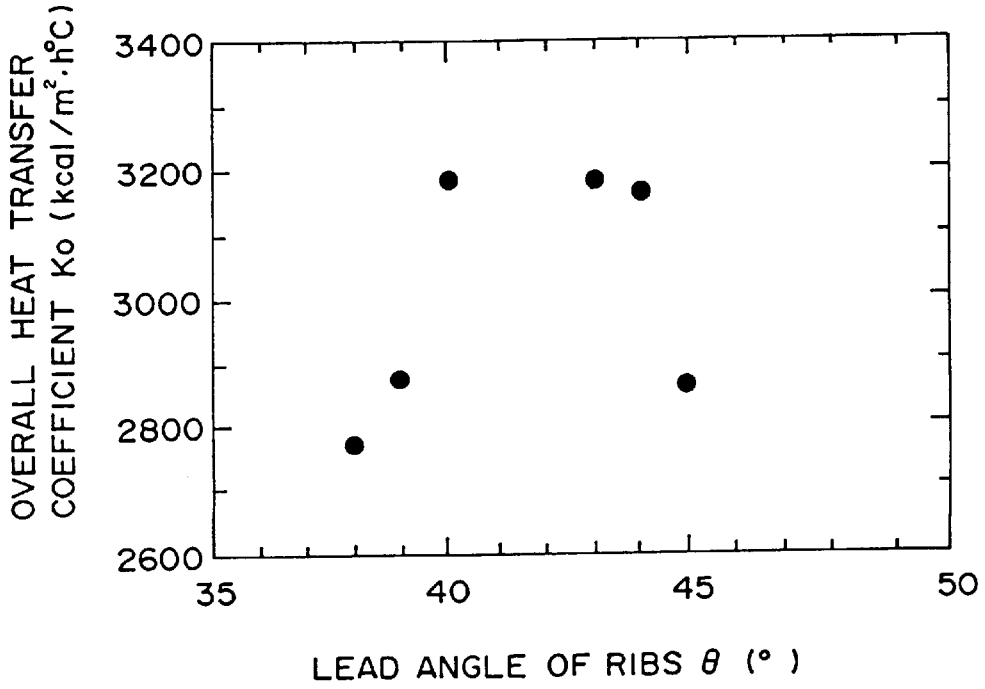
FIG. 13 is a graph for showing a relationship between an overall heat transfer coefficient and a lead angle of ribs θ.
Figure 14:
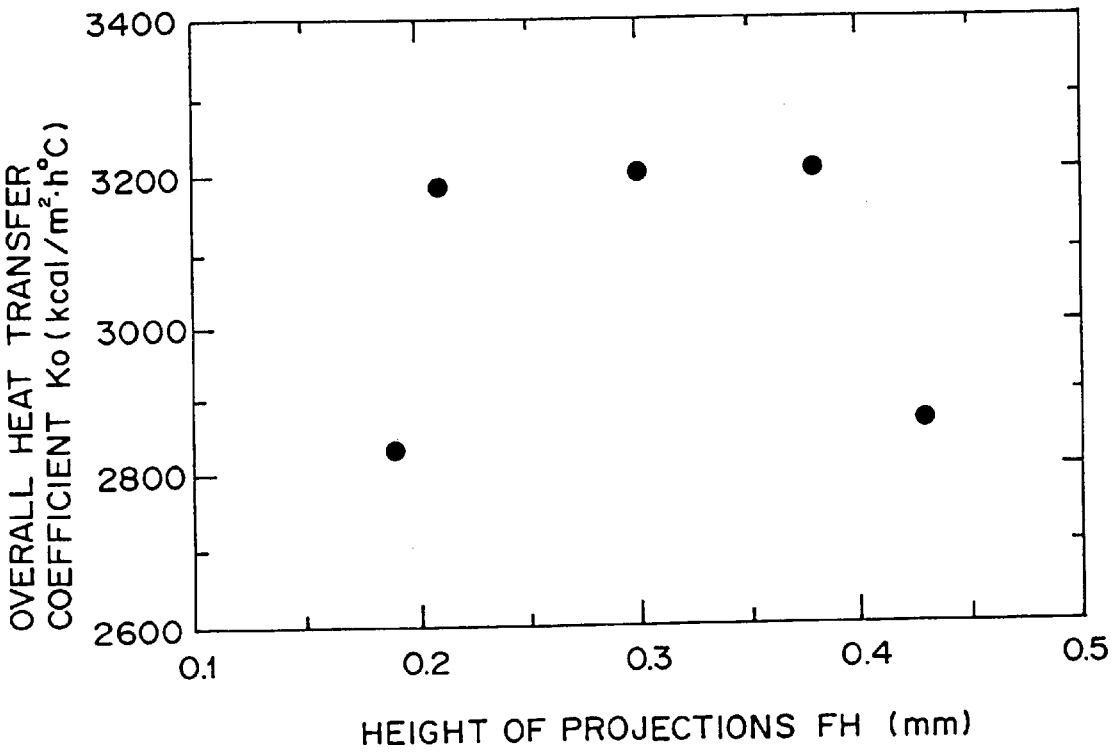
FIG. 14 is a graph for showing a relationship between an overall heat transfer coefficient and a projection height FH.

FIG. 10 is a graph for showing a relationship between an overall heat transfer coefficient obtained from the above equation (1) and the pitch of the projections PF. FIG. 11 is a graph for showing a relationship between an overall heat transfer coefficient and the area rate A. FIG. 12 is a graph for showing a relationship between an overall heat transfer coefficient and the pitch P of concavities. FIG. 13 is a graph for showing a relationship between an overall heat transfer coefficient and the lead angle θ of the ribs. And FIG. 14 is a graph for showing a relationship between an overall heat transfer coefficient and the height FH of the projections. As shown in FIGS. 10 to 14 and in Table 1, the overall heat transfer coefficients of the examples A1 to A13 were higher than the overall heat transfer coefficients of the comparative examples B1 to B15, for the refrigerant dispersed at the rate of 1.0 kg/m/sec.

According to the present invention, there is provided an effect that the spreading property of the refrigerant improves, and the evaporation performance and the absorption performance are improved extremely because of a thin forming of the refrigerant liquid film and absorption liquid. The heat exchanger tube of the examples A1 to A13 have superior evaporation heat transfer property and absorption heat transfer property. Therefor, according to the present invention, the same type of the heat exchanger tubes can be fabricated in an evaporator and an absorber.

Second Example

There will be explained below results of tests carried out for verifying the effect of a second embodiment of the present invention shown in FIGS. 4 to 8.

Following Table 2 and Table 3 below show sizes of the external surface and the internal surface of a tube, and Table 2 shows the examples of the present invention and Table 3 shows the comparative examples.

TABLE 2

| | Original Tube | | Fin Fabricated Part | | | | | | | | Heat Transfer Performance Overall Heat Transfer Coefficient (kcal/m$^2$ · h · ° C.) |
|---|---|---|---|---|---|---|---|---|---|---|---|
| No. | $D_o$ | T | DF | FW | PF | A | P | PR | AF | θ | $K_o$ |
| Example | | | | | | | | | | | |
| C1 | 16.0 | 0.7 | 15.84 | 0.55 | 0.976 | 0.377 | 6.22 | 0.61 | 0.25 | 43 | 2501 |
| C2 | 16.0 | 0.7 | 15.83 | 0.54 | 0.632 | 0.375 | 6.22 | 0.61 | 0.25 | 43 | 2580 |
| C3 | 16.0 | 0.7 | 15.84 | 0.56 | 1.314 | 0.382 | 6.22 | 0.61 | 0.25 | 43 | 2510 |
| C4 | 16.0 | 0.7 | 15.85 | 0.55 | 0.977 | 0.377 | 6.24 | 0.61 | 0.25 | 30 | 2595 |
| C5 | 16.0 | 0.7 | 15.85 | 0.55 | 0.977 | 0.377 | 6.24 | 0.61 | 0.25 | 50 | 2580 |
| C6 | 19.0 | 0.7 | 18.90 | 0.55 | 0.977 | 0.377 | 5.75 | 0.61 | 0.25 | 43 | 2505 |
| C7 | 16.0 | 0.7 | 15.91 | 0.55 | 0.976 | 0.377 | 6.75 | 0.61 | 0.25 | 43 | 2598 |
| C8 | 12.7 | 0.7 | 12.60 | 0.55 | 0.977 | 0.377 | 6.59 | 0.61 | 0.25 | 43 | 2503 |

TABLE 2-continued

| | Original Tube | | Fin Fabricated Part | | | | | | | | Heat Transfer Performance Overall Heat Transfer Coefficient (kcal/m$^2$ · h · ° C.) |
|---|---|---|---|---|---|---|---|---|---|---|---|
| No. | $D_o$ | T | DF | FW | PF | A | P | PR | AF | θ | $K_o$ |
| C9 | 16.0 | 0.7 | 15.84 | 0.55 | 0.977 | 0.398 | 6.22 | 0.61 | 0.25 | 43 | 2585 |
| C10 | 16.0 | 0.7 | 15.84 | 0.55 | 0.977 | 0.252 | 6.22 | 0.61 | 0.25 | 43 | 2583 |
| C11 | 16.0 | 0.7 | 15.85 | 0.55 | 0.977 | 0.377 | 6.22 | 0.51 | 0.25 | 43 | 2590 |
| C12 | 16.0 | 0.7 | 15.84 | 0.55 | 0.977 | 0.377 | 6.22 | 1.18 | 0.25 | 43 | 2590 |
| C13 | 16.0 | 0.7 | 15.84 | 0.55 | 0.976 | 0.377 | 6.22 | 0.61 | 0.06 | 43 | 2515 |
| C14 | 16.0 | 0.7 | 15.84 | 0.55 | 0.976 | 0.377 | 6.22 | 0.61 | 0.63 | 43 | 2528 |

TABLE 3

| | Original Tube | | Fin Fabricated Part | | | | | | | | Heat Transfer Performance Overall Heat Transfer Coefficient (kcal/m$^2$ · h · ° C.) |
|---|---|---|---|---|---|---|---|---|---|---|---|
| No. | $D_o$ | T | DF | FW | PF | A | P | PR | AF | θ | $K_o$ |
| Comparative Example | | | | | | | | | | | |
| D1 | 16.0 | 0.7 | 15.85 | 0.55 | 0.609 | 0.375 | 6.22 | 0.61 | 0.25 | 43 | 1982 |
| D2 | 16.0 | 0.7 | 15.84 | 0.55 | 0.594 | 0.375 | 6.22 | 0.61 | 0.25 | 43 | 2069 |
| D3 | 16.0 | 0.7 | 15.84 | 0.55 | 1.351 | 0.375 | 6.22 | 0.61 | 0.25 | 43 | 2083 |
| D4 | 16.0 | 0.7 | 15.84 | 0.56 | 1.437 | 0.375 | 6.22 | 0.61 | 0.25 | 43 | 1850 |
| D5 | 16.0 | 0.7 | 15.85 | 0.54 | 0.976 | 0.239 | 6.22 | 0.61 | 0.25 | 43 | 2012 |
| D6 | 16.0 | 0.7 | 15.85 | 0.55 | 0.976 | 0.417 | 6.22 | 0.61 | 0.25 | 43 | 2005 |
| D7 | 16.0 | 0.7 | 15.85 | 0.56 | 0.976 | 0.377 | 5.53 | 0.61 | 0.25 | 43 | 2070 |
| D8 | 16.0 | 0.7 | 15.84 | 0.55 | 0.977 | 0.378 | 5.64 | 0.61 | 0.25 | 43 | 2082 |
| D9 | 16.0 | 0.7 | 15.86 | 0.55 | 0.976 | 0.376 | 7.11 | 0.61 | 0.25 | 43 | 1950 |
| D10 | 16.0 | 0.7 | 15.84 | 0.56 | 0.976 | 0.377 | 6.92 | 0.61 | 0.25 | 43 | 2068 |
| D11 | 16.0 | 0.7 | 15.85 | 0.54 | 0.976 | 0.378 | 6.22 | 0.61 | 0.25 | 28 | 2075 |
| D12 | 16.0 | 0.7 | 15.84 | 0.54 | 0.977 | 0.376 | 6.22 | 0.61 | 0.25 | 53 | 2082 |
| D13 | 16.0 | 0.7 | 15.84 | 0.55 | 0.975 | 0.377 | 6.22 | 0.61 | 0.25 | 55 | 1880 |
| D14 | 16.0 | 0.7 | 15.85 | 0.55 | 0.977 | 0.377 | 6.22 | 0.48 | 0.25 | 43 | 2090 |
| D15 | 16.0 | 0.7 | 15.84 | 0.55 | 0.977 | 0.377 | 6.22 | 1.25 | 0.25 | 43 | 1890 |
| D16 | 16.0 | 0.7 | 15.84 | 0.55 | 0.976 | 0.377 | 6.22 | 0.61 | 0.03 | 43 | 2015 |
| D17 | 16.0 | 0.7 | 15.84 | 0.55 | 0.976 | 0.377 | 6.22 | 0.61 | 0.68 | 43 | 2028 |

In Tables 2 and 3, each mark denotes following size.

Do: external diameter of the original tube (mm)

T: wall thickness of the original tube (mm)

DF: external diameter of the fin fabricated part (mm)

FW: thickness of the bottom wall (mm)

PF: pitch of the projection in tube axial direction (mm)

A: area rate of the projection

P: Pitch of the concavities (mm)

PR: pitch of the projections in the tube circumferential direction (mm)

AF: A rate AF which is a rate of an area AF1 of an extended part of an edge portion of projections to an area AF2 of a space sandwiched between the projections.

θ: an angle θ formed by the concavities 33 on the external surface of the tube with respect to the tube axis.

Test conditions are set as follows.

Pressure in the vessel: 6.0 mmHg

Density of the LiBr water solution at the inlet: 63% by weight

Temperature of the LiBr water solution at the inlet: 46° C.

Flow speed of the cooling water: 1.50 m/sec

Temperature of the cooling water at the inlet: 32° C.

Flow quantity of the LiBr water solution: 0.017 to 0.035 kg/ms

Surfactant: 2-ethylhexanol-added

Layout of the tubes: 1 row×6 stages (stage pitch 26 mm)

Number of paths: 6 paths

The flow quantity of the cooling water is set based on the cross section of the end portion of the tube (original tube). Further, flow quantity of the LiBr water solution is the quantity of the absorption liquid flowing down along one side of the tube. An overall heat transfer coefficient $K_0$ was calculated from the measured value obtained, based on said equation (1).

Figure 15:
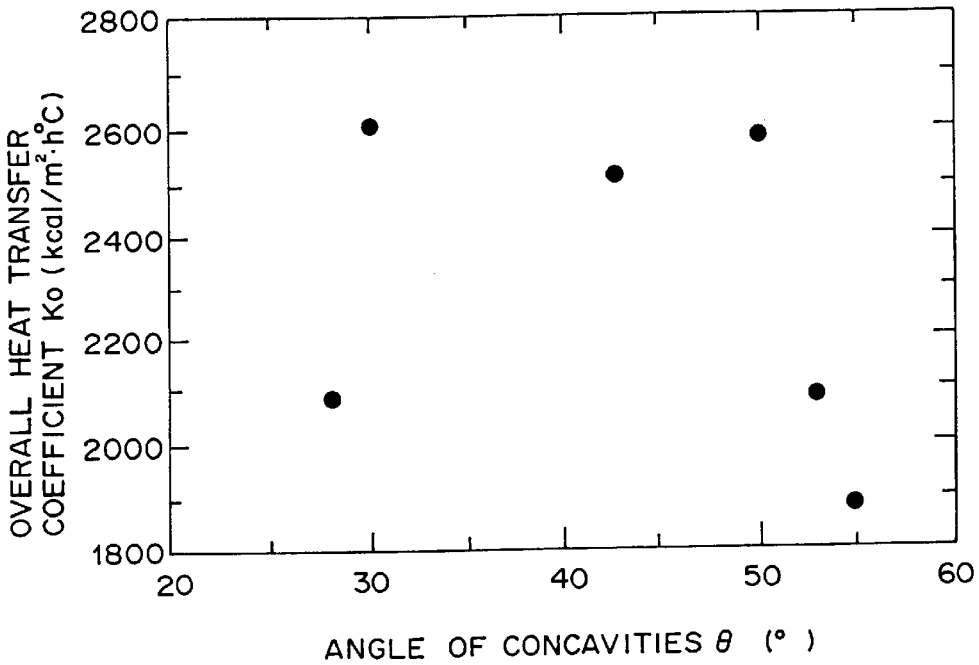
FIG. 15 is a graph for showing a relationship between an overall heat transfer coefficient and an angle θ formed by concavities on an external surface of a tube with respect to a tube axis.
Figure 16:
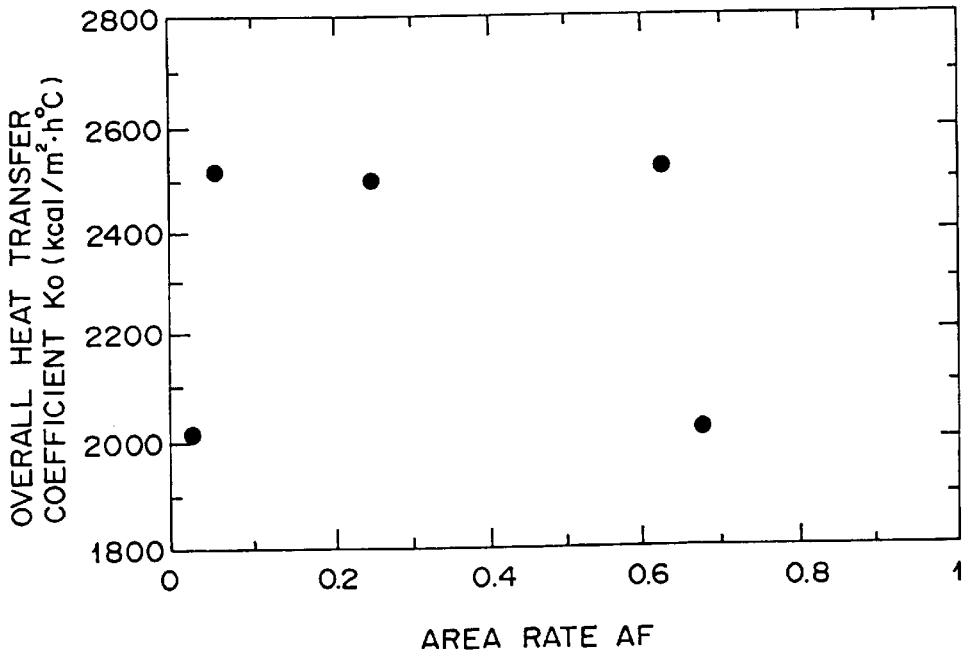
FIG. 16 is a graph for showing a relationship between an overall heat transfer coefficient and an area rate AF which is a rate of an area AF1 of an extended part of an edge portion of projections to an area AF2 of a space sandwiched between the projections.
Figure 17:
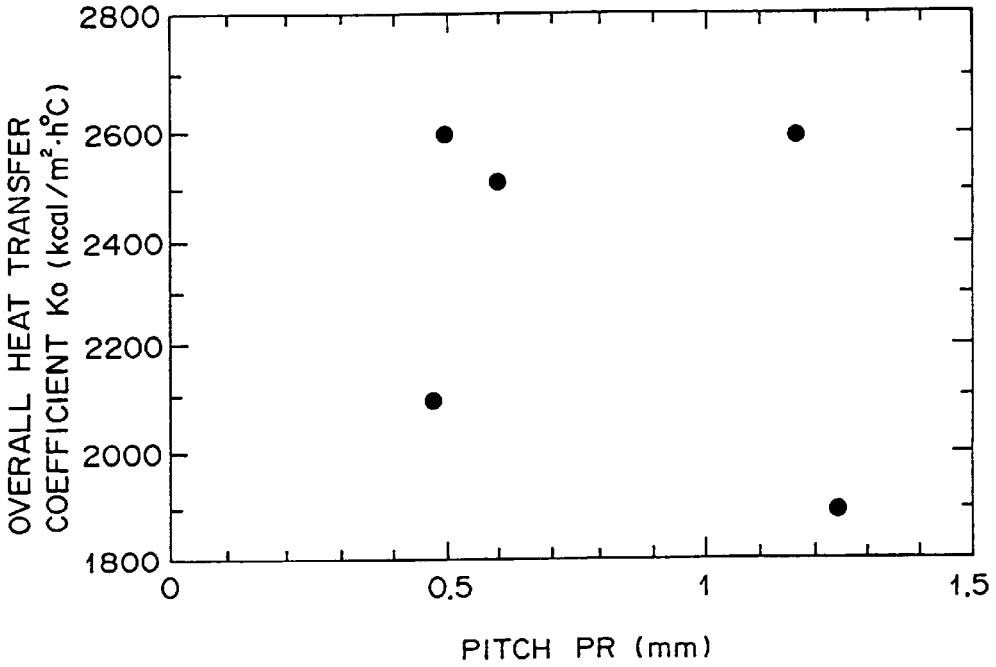
FIG. 17 is a graph for showing a relationship between an overall heat transfer coefficient and a pitch PR of a projection 4 in a tube circumferential direction.
Figure 18:
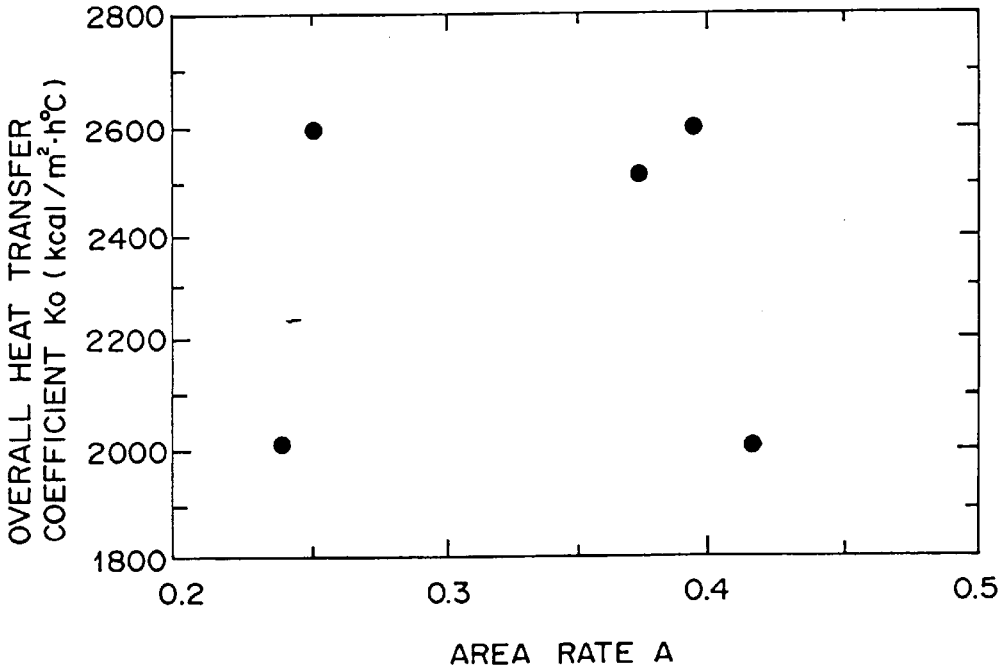
FIG. 18 is a graph for showing a relationship between an overall heat transfer coefficient and an area rate A which is a rate of an area of an upper surface of a projection to an area of a bottom surface of the projection.
Figure 19:
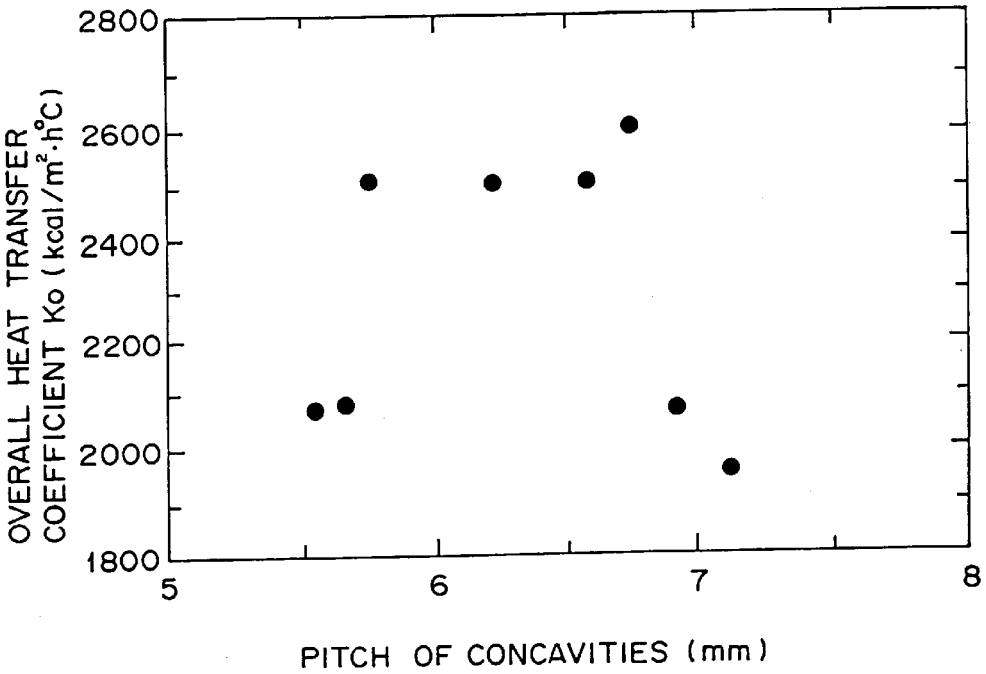
FIG. 19 is a graph for showing a relationship between an overall heat transfer coefficient and a circumferential length pitch P of the concavities on the external surface of the tube.
Figure 20:
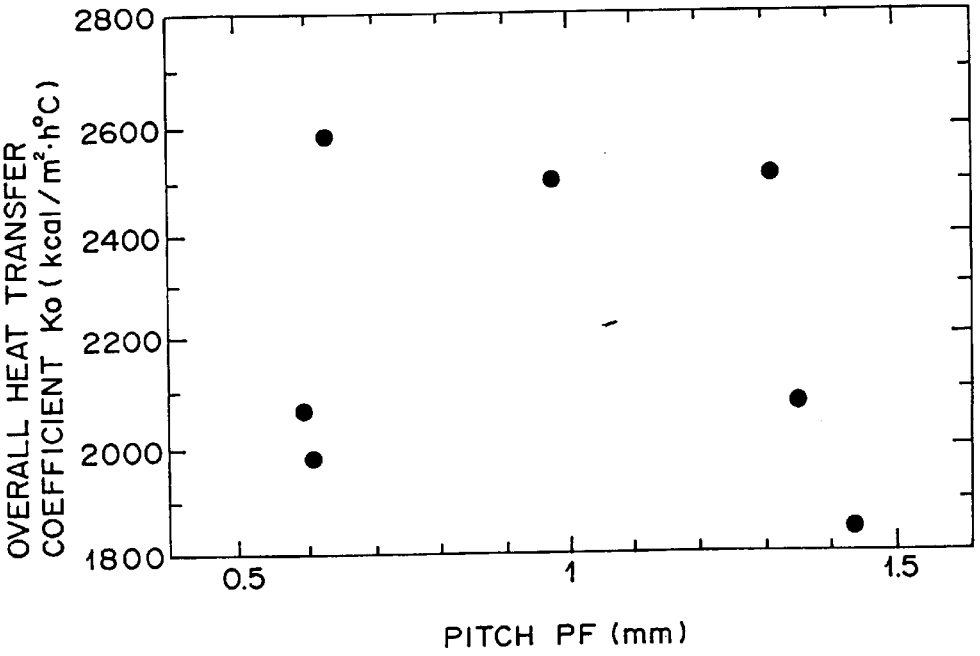
FIG. 20 is a graph for showing a relationship between an overall heat transfer coefficient and a pitch PF of projections on a cross section orthogonal with a tube axis.

FIG. 15 is a graph for showing a relationship between an overall heat transfer coefficient obtained from the equation (1) and an angle θ formed by concavities 33 on an external surface of a tube with respect to a tube axis. FIG. 16 is a graph for showing a relationship between an overall heat transfer coefficient and an area rate AF which is a rate of an area AF1 of an extended part 35 of an edge portion of the projections to an area AF2 of a space sandwiched between the projections. FIG. 17 is a graph for showing a relationship between an overall heat transfer coefficient and a pitch PR of a projection 34 in a tube circumferential direction. FIG. 18 is a graph for showing a relationship between an overall heat transfer coefficient and an area rate A which is a rate of an area of an upper surface of a projection 34 to an area of a bottom surface of the projection 34. FIG. 19 is a graph for showing a relationship between an overall heat transfer coefficient and a circumferential length pitch P of the concavities 33 on the external surface of the tube. FIG. 20 is a graph for showing a relationship between an overall heat transfer coefficient and a pitch PF of projections 34 on a cross section orthogonal with a tube axis. As shown in FIGS. 15 to 20 and in Tables 2 and 3, the overall coefficients of heat transfer of the examples C1 to C14 that satisfy claims 9 to 15 of the present invention were higher than the overall coefficients of heat transfer of the comparative examples D1 to D17.

As explained above, according to the present invention, since the edge of the independent projections extend in the tube axial direction to form extended parts and since concavities are provided on the external surface of the tube, there is exhibited improved spreading property of the absorption liquid in the tube circumferential direction and in the tube axial direction, resulting in an improved absorption heat transfer performance. This makes it possible to provide a compact apparatus with high performance, and to reduce the quantities of materials for structuring the heat exchanger tube.

What is claimed is:

1. A falling film type heat exchanger tube for promoting a heat exchange between a liquid film on an external surface of a tube and a liquid flowing through inside the tube, comprising:

ribs formed as a protrusion on an internal surface of the tube and extending spirally with a suitable distance between adjacent ribs;

concavities formed on the external surface of the tube and extending spirally with a suitable distance between adjacent concavities; and a plurality of independent projections formed on the external surface of the tube and laid out spirally, at least one of said projections having a recess formed on its upper surface in such a way that an area of said at least one projection is aligned with said ribs on the internal surface of the tube is lower than another area of said at least one of projection which is aligned with an area between the ribs.

2. A falling film type heat exchanger tube according to claim 1, wherein the concavities on the external surface of the tube and the ribs on the internal surface of the tube are being formed at positions mutually aligned with each other.

3. A falling film type heat exchanger tube according to claim 1, wherein each projection is formed in a quadrangular pyramid shape.

4. A falling film type heat exchanger tube according to claim 3, wherein the height of each projection is within a range from 0.20 to 0.40 mm.

5. A falling film type heat exchanger tube according to claim 1, wherein each projection has an area rate (A) within a range of $0.25 \leqq A \leqq 0.40$ as the rate of the area of the upper surface to the area of the bottom surface.

6. A falling film type heat exchanger tube according to claim 1, wherein from the viewpoint of the cross section orthogonal with the tube axis, a pitch (P) of the concavities on the upper surface of the independent projections is within a range of $5.75 \leqq P \leqq 6.75$ mm.

7. A falling film type heat exchanger tube according to claim 1, wherein an angle θ formed by the ribs with the tube axial direction is within a range of $40° \leqq \theta \leqq 44°$.

8. A falling film type heat exchanger tube according to claim 1, wherein a pitch PF of the projections in the tube axial direction is within a range of $0.89 \leqq PF \leqq 1.12$ mm.

9. A falling film type heat exchanger tube according to claim 1, wherein the edge of said projections are extended to the tube axial direction, and the heat exchanger tube is used for an absorber.

10. A falling film type heat exchanger tube according to claim 9, wherein each projection has an area rate (A) within a range of $0.25 \leqq A \leqq 0.40$ as the rate of the area of the upper surface to the area of the bottom surface.

11. A falling film type heat exchanger tube according to claim 9, wherein from the viewpoint of the cross section orthogonal with the tube axis, a pitch (P) of the concavities on the upper surface of the independent projections is within a range of $5.75 \leqq P \leqq 6.75$ mm.

12. A falling film type heat exchanger tube according to claim 9, wherein an angle θ formed by the concavities on the external surface of the tube with respect to the tube axial direction is within a range of $30° \leqq \theta \leqq 50°$.

13. A falling film type heat exchanger tube according to claim 9, wherein a pitch PF of the projections in the tube axial direction is within a range of $0.62 \leqq PF \leqq 1.33$ mm.

14. A falling film type heat exchanger tube according to claim 9, wherein a pitch PR of the projections in the tube circumferential direction is within a range of $0.50 \leqq PR \leqq 1.20$ mm.

15. A falling film type heat exchanger tube according to claim 9, wherein an area rate (AF), which is a rate of an area (AF1) of the extended part of the edge portion of the projections to a cross sectional area (AF2) of the space sandwiched between the projections, is within a range of $0.05 \leqq AF \leqq 0.65$.

* * * * *

UNITED STATES PATENT AND TRADEMARK OFFICE

CERTIFICATE OF CORRECTION

PATENT NO. : 6,056,048

DATED : May 2, 2000

INVENTOR(S): Hiroyuki TAKAHASHI et al.

It is certified that an error appears in the above-identified patent and that said Letters Patent is hereby corrected as shown below:

On the title page, item [75], the 3rd and 4th Inventors' are omitted. It should read as follows:

--[75] Inventors: Hiroyuki Takahashi; Chikara Saeki, both of Kanagawa; Masahiro Furukawa; Kazuyasu Iramina, both of Gunma, all of Japan--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*